United States Patent [19]

Kjellström

[11] Patent Number: 4,982,474

[45] Date of Patent: Jan. 8, 1991

[54] DOOR BLOCKING DEVICE

[76] Inventor: Åke Kjellström, S-616 00, Åby, Sweden

[21] Appl. No.: 435,455

[22] PCT Filed: Jun. 7, 1988

[86] PCT No.: PCT/SE88/00306

§ 371 Date: Nov. 28, 1989

§ 102(e) Date: Nov. 28, 1989

[87] PCT Pub. No.: WO88/09861

PCT Pub. Date: Dec. 15, 1988

[51] Int. Cl.[5] ..... E05F 5/02

[52] U.S. Cl. ..... 16/82; 292/338

[58] Field of Search ..... 16/82; 292/338

[56] References Cited

U.S. PATENT DOCUMENTS

| | | | |
|---|---|---|---|
| 614,741 | 11/1898 | Moore | 292/338 |
| 742,782 | 10/1903 | Foster | 16/85 |
| 890,207 | 6/1908 | Anderson . | |
| 1,105,963 | 8/1914 | Clem | 16/86 A |
| 1,827,143 | 10/1931 | Doyle . | |
| 3,055,043 | 9/1962 | Luttner, Jr. | 16/86 |
| 4,015,867 | 4/1977 | Siden | 292/262 |

FOREIGN PATENT DOCUMENTS

| | | |
|---|---|---|
| 361926 | 10/1922 | Fed. Rep. of Germany . |
| 1591351 | 6/1970 | France . |
| 2110636 | 6/1972 | France . |
| 140472 | 5/1953 | Sweden . |

*Primary Examiner*—Richard K. Seidel
*Assistant Examiner*—Carmine Cuda
*Attorney, Agent, or Firm*—Jeffers, Hoffman and Niewyk

[57] ABSTRACT

The present invention relates to an arrangement for a door intended, in conjunction with the closing of same, to prevent injury by crushing between the door leaf (4) and the case (2). The arrangement (1) comprises a body component (5) with a plane surface (7) intended to be mounted against the door leaf (4). A longitudinal locking component (6) is pivotally mounted in the body component (5). A spring (9) acts between the aforementioned body and locking components (5, 6), which have devices which define a relative angular position. This means essentially that the direction of longitudinal extension of the locking component (6) forms a normal to the plane surface (7) of the body component (5). The spring (9) forces the components (5, 6) to adopt the aforementioned angular position. The body component (5) with the locking component (6) mounted in it is intended to be mounted on the inside of the door leaf (4) in a position such that, as the door is opened from a closed position, the locking component (6), sliding against the door case (2) along its length, finally leaves the case and freely adopts the aforementioned relative angular position. When the door is closed again, the free end of the locking component (6) will come up against the case (2), thus preventing the door from being fully closed.

2 Claims, 3 Drawing Sheets

DOOR BLOCKING DEVICE

BACKGROUND OF THE INVENTION

The present invention relates to an arrangement for a door intended, in conjunction with the closing of same, to prevent injury by crushing between the door leaf and the case, comprising a body component with a plane surface intended to be mounted against the door leaf, in which body component a longitudinal blocking component is pivotally mounted.

A large number of such injuries by crushing occurs every year, mainly to the hands and fingers in conjunction with playing with doors or as a result of doors blowing shut in cross-draughts, etc. Not only are injuries by crushing extremely painful, but they can also cause disfigurement for life.

SUMMARY OF THE INVENTION

The object of the present invention is to make available an arrangement which automatically eliminates injury by crushing around all the edges of the door, the manner in which this is achieved being characterized in that the aforementioned body and blocking components have means which define a relative angular position essentially involving the direction of longitudinal extension of the blocking component forming a normal to the plane surface of the body component, which angular position the components are forced to adopt by a spring acting between said body, and blocking components in conjunction with which the body component with the blocking component mounted in it is intended to be mounted on the inside of the door leaf in a position such that, as the door is opened from a closed position, the blocking component, sliding against the door case along its length, finally leaves the case and freely adopts the aforementioned relative angular position in which, when the door is closed again, the free end of the blocking component will come up against the case and will thus prevent the door from being fully closed and that the arrangement comprises a buffer element intended to be applied to the door case at the point at which the free and of the blocking component is expected to come up against the case, which buffer element exhibits a concave, curved surface for the aforementioned free end of the blocking component. By means of the buffer element is achieved a relatively gentle arresting of the movement of the door towards its closed position on the one hand, and on the other hand no impact marks are produced on the door case when the free end of the blocking components makes contact with the case.

In accordance with one particular characteristic feature of the invention, the arrangement comprises a buffer element intended to be applied to the door case at a point at which the free end of the blocking component is expected to come up against the case, which by means of the buffer element is achieved a relatively gentle arresting of the movement of the door towards its closed position on the one hand, and on the other hand no impact marks are produced on the door case when the free end of the blocking components makes contact with the case.

In accordance with a particular characteristic feature of the invention, the arrangement comprises a snap-action device acting between the aforementioned components and so arranged, against the action of the spring, as to retain the blocking component in a detachable fashion, preferably so that the direction of longitudinal extension of the blocking components is approximately parallel with the plane surface of the body component. With the help of this snap-action device it is possible, for example, for grandparents to set the arrangement to function only when the grandchildren are visiting.

BRIEF DESCRIPTION OF THE DRAWINGS

The invention is described below in more detail with reference to the accompanying drawing, which illustrates in plan view from above the function of an arrangement in accordance with the invention during the following phases: door closed, FIG. 1; door prevented from being closed, FIG. 2; and arrangement in the inactive position, FIG. 3.

DESCRIPTION OF THE PREFERRED EMBODIMENT

Figure 1:
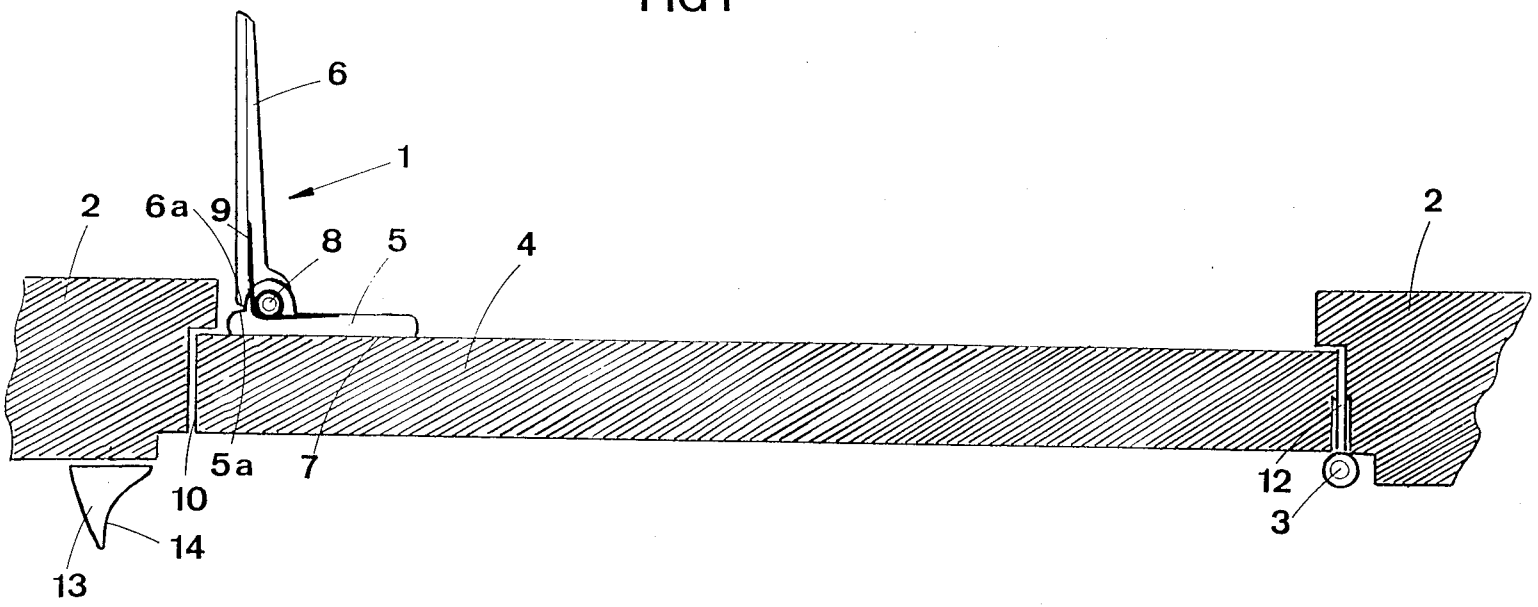

The designation 1 is used in the drawing generally in respect of an arrangement in accordance with the invention, which is referred to below as an anti-crushing guard, and the designation 2 is used in respect of a door case with a hinge 3, which supports a door leaf 4.

The anti-crushing guard 1 comprises a body component 5 and a longitudinal blocking component 6 pivotally mounted therein. The body component 5 has a plane surface 7 intended to be mounted on the door leaf 4. The mounting of the blocking component 6 in the body component 5 is constituted by a pin 8.

The body and blocking components 5 and 6 are executed with devices **5*a* and 6*a* so arranged as to define a relative angular position between the components 5 and 6. The aforementioned devices consist, in the embodiment illustrated in the drawing, of two surfaces, which, in the aforementioned relative position, which essentially means that the longitudinal extent of the blocking components 6 forms a normal to the plane surface 7 of the body component 5, are constituted by a surface 5*a* parallel with the plane surface 7 and the end surface 6*a* of the blocking component 6 situated closest to the mounting. The components 5, 6 are caused by a spring 9 arranged in conjunction with the mounting between the body and blocking components to adopt the aforementioned relative position in which the end surface 6*a* of the blocking component 6 rests against the surface 5*a* of the body component 5**.

Figure 2:
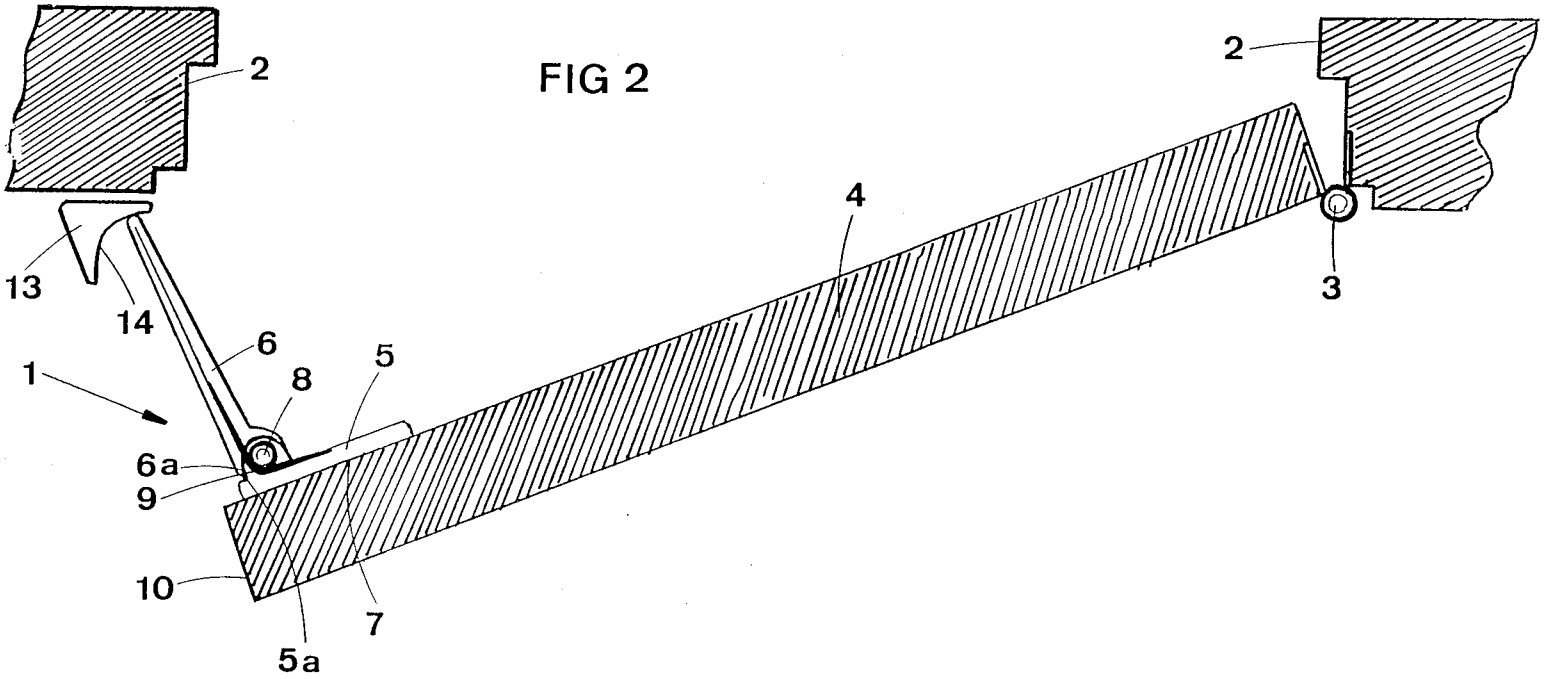

The arrangement 1 is intended to be installed with the plane surface 7 facing towards the inside of the door leaf 4, at a height above the floor such that it is out of reach of small children and in a position relative to the front edge 10 of the door leaf 4 such that, as the door is opened, the blocking component 6 will first slide along the door case 2 along its length. Once it finally moves out of contact with the case 2, the blocking component 6 is caused by the spring 9 to adjust to a position in which it is approximately perpendicular to the door leaf 4. When the door is closed once more, the free end 11 of the blocking component 6 will come into contact with the case 2 and will thus prevent the door from being fully closed. The risk of injury by crushing is eliminated entirely in this way, not only between the case 2 and the front edge 10 of the door leaf 4, but also between the case 2 and the edge 12 of the door leaf 4 facing towards the hinge 3. In order to prevent damage to the case 2 at the point at which the free end of the blocking component 6 is expected to come into contact with the case 2, a buffer element 13 with a concave, curved contact surface 14 for the free end 11 of the blocking component 6 is fitted at the point; see in particular FIG. 2. The concave, curved surface 14 serves the purpose of rendering the braking of the door more gentle.

Figure 3:
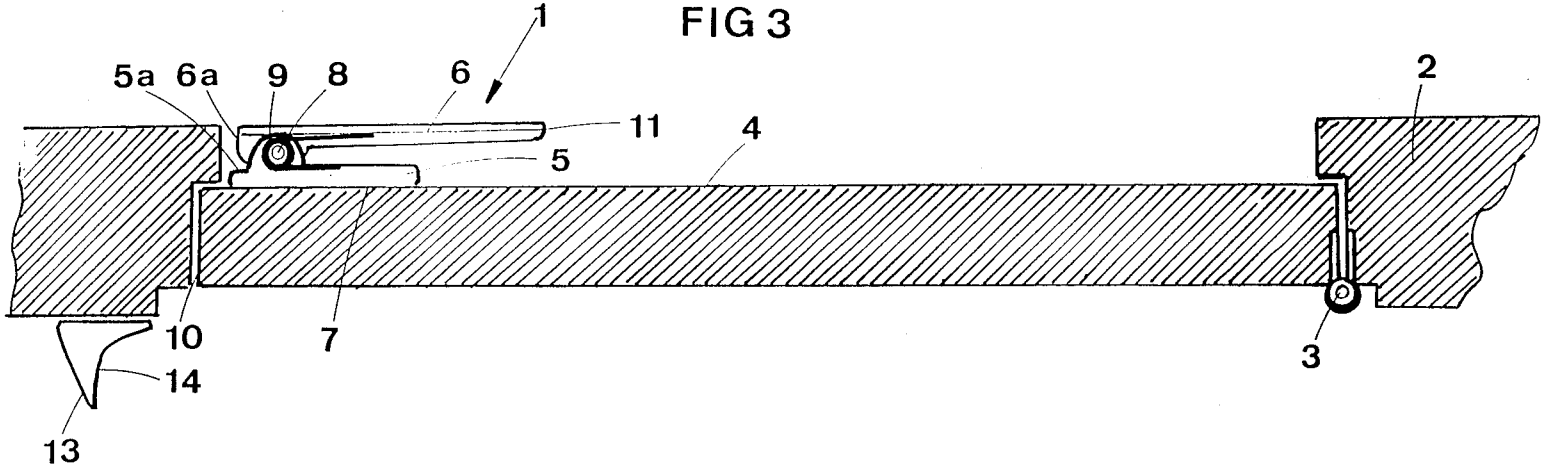

By means of a snap-action device acting between the body and blocking components 5, 6, which device is preferably arranged in the mounting between the aforementioned components, the blocking component 6 is retained against the effect of the spring 9 in an inactive position (see FIG. 3) in which the direction of longitudinal extension of the blocking component 6 is approximately parallel with the door leaf 4. If necessary, the blocking component 6 can be released so as to act in the manner described above.

What is claimed is:

1. Arrangement for a door intended, in conjunction with the closing of same, to prevent injury by crushing between the door leaf and the case, comprising a body component with a plane surface intended to be mounted against the door leaf, in which body component a longitudinal blocking component is pivotally mounted, characterized in that the aforementioned body and blocking components have means which define a relative angular position essentially involving the direction of longitudinal extension of the blocking component forming a normal to the plane surface of the body component, which angular position the components are forced to adopt by a spring, acting between said body and blocking components in conjunction with which the body component with the blocking component mounted in it is intended to be mounted on the inside of the door leaf in a position such that, as the door is opened from a closed position, the blocking component, sliding against the inside of the door case along its length, finally leaves the case and freely adopts the aforementioned relative angular position in which, when the door is closed again, the free end of the blocking component will come up against the front of the case and will thus prevent the door from being fully closed and that the arrangement comprises a buffer element intended to be applied to the front of the door case at the point at which the free end of the blocking component is expected to come up against the front of the case, which buffer element exhibits a concave, curved contact surface for the aforementioned free end of the blocking component.

2. Arrangement according to patent claim 1, characterized in that the arrangement comprises a snap-action device acting between the aforementioned components and so arranged, against the action of the spring, as to retain the blocking component in a detachable fashion in an inactive position, preferably so that the direction of longitudinal extension of the blocking component is approximately parallel with the plane surface of the body component.

* * * * *

UNITED STATES PATENT AND TRADEMARK OFFICE

CERTIFICATE OF CORRECTION

PATENT NO. :4,982,474

DATED :January 8, 1991

INVENTOR(S) :Ake Kjellstrom

It is certified that error appears in the above-identified patent and that said Letters Patent is hereby corrected as shown below:

ON THE TITLE PAGE:

Please substitute the following Abstract :

--[57] ABSTRACT

An arrangement for a door to prevent injury by crushing between the door and the case upon closing of the door. The arrangement includes a body component having a plane surface mounted against the door, and a blocking component pivotally mounted to the body component. A spring acts between the body and blocking components, forcing them to assume a relative angular position wherein the extension of the blocking component is normal to the plane surface of the body component. The assembly of the body and blocking components is mounted on the inside of a door such that, as the door is opened, the spring-biased blocking component slides along the case until it is beyond the case and adopts the angular position. Thereafter, upon closing of the door, the blocking component will abut the case, thereby preventing the door from being fully closed.--

Signed and Sealed this

Sixteenth Day of June, 1992

*Attest:*

DOUGLAS B. COMER

*Attesting Officer*

*Acting Commissioner of Patents and Trademarks*